United States Patent [19]

Morgan et al.

[11] Patent Number: 4,657,403

[45] Date of Patent: Apr. 14, 1987

[54] AQUATIC EVENT TIMING DEVICE

[75] Inventors: John A. Morgan, Essex; William Bartula, Manchester; Richard D. Gilbert, Rockport, all of Mass.

[73] Assignee: RJB Timing Systems, Inc., Danvers, Mass.

[21] Appl. No.: 755,431

[22] Filed: Jul. 16, 1985

[51] Int. Cl.[4] ..... G04F 8/00

[52] U.S. Cl. ..... 368/6

[58] Field of Search ..... 368/10, 1, 2, 3, 6

[56] References Cited

U.S. PATENT DOCUMENTS

| | | | |
|---|---|---|---|
| 2,547,332 | 4/1951 | Loveless et al. | 177/384 |
| 3,603,952 | 9/1971 | Smith | 340/224 |
| 3,890,463 | 6/1975 | Ikegami et al. | 178/6.8 |
| 4,072,941 | 2/1978 | Hamid et al. | 343/5 NA |
| 4,228,556 | 10/1980 | Searls | 9/14 |

FOREIGN PATENT DOCUMENTS 2623568 8/1977 Fed. Rep. of Germany .

*Primary Examiner*—Bernard Roskoski

*Attorney, Agent, or Firm*—Kenyon & Kenyon

[57] ABSTRACT

An apparatus for timing of water-based activities or events, such as, sailboarding, yachting, motorboating and swimming. The apparatus comprises a rigid horizontal support bar, two vertical members attached to the ends of the support bar, buoyant floats attached to the vertical members and a transmitter/receiver package disposed on the vertical members. The apparatus acts as a gate which individuals or water-vehicles passing therethrough are detected or timed by the transmitter/receiver package contained thereon. The apparatus is kept stabilized by being secured to any nearby stationary object and by adapting the submerged portion of the apparatus to provide negative buoyancy.

12 Claims, 3 Drawing Figures

AQUATIC EVENT TIMING DEVICE

BACKGROUND OF INVENTION

This invention relates generally to a timing apparatus and more particularly to a water-based timing apparatus whereby aquatic sports and pleasure activities such as sailboarding, yachting, motorboating and swimming may be timed and otherwise supervised.

In most water-based sports and the like, the critical points of a race such as the start, finish and completion of legs or laps, are generally determined by the passage of the participants through a reference line. The timing of such passage is usually recorded by the use of either hand-held stopwatches or some form of computer controlled timing system, either of which are activiated by an individual actually observing the passage of each participant through the reference line.

The timing of water-based sports and the like is complicated by the fact that participants are often staggered or vying closely for position as they pass through the reference line. Moreover, because the start, completion of laps or legs, and finish of such races are determined for each participant by physically eyeing the point at which that participant crosses the starting line, timing may be further complicated by the angle of view, the degree to which the participant is obscured by other objects, including other participants, and human error generally.

Further problems are presented by the so-called "flying start", in which it is the object of each participant to remain as close as possible to other participants in proceeding through the reference line, while not crossing the line before a starting signal is given. Because of the rapid motion of participants in events such as motorboating, it is often extremely difficult to determine by direct observation which participants should be disqualified for crossing the starting line prior to the official start of the race. Moreover, because such a start is presently judged by the use of a photograph to determine any disqualification, one must therefore wait until such photograph is developed to make rulings. Accordingly, races are well under way or are completed before a restart may be ordered, and often, as a result, participants can afford but one mistake in running such a race.

As a result of such complications, supervision and timing of aquatic races requires close scrutiny and is often subject to substantial error. Since such races are often determined in seconds or fractions of seconds, this error can be crucial indeed.

It is accordingly an object of the present invention to provide an improved means for judging the start, finish and completion of laps or legs of a timed aquatic event such as a sailboat, motorboat or yacht race.

It is a further object of the invention to provide an improved means whereby the time at which participants in an aquatic sport and the like pass through a reference line may be more accurately determined.

It is another object of the invention to provide a water-based apparatus whereby participants may pass between two sensing means contained thereon to actually record the occurrence and time of such passage during an aquatic race.

It is still a further object of the invention to provide a water-based apparatus which is stabilized such that its position in the water is relatively constant thereby allowing for the improved recording of data therefrom pertinent to position and timing of objects passing therethrough.

It is a further object of the invention to provide a stable and torsionally rigid floating apparatus to act as a base for a transmitter/receiver package adapted to detect the presence of an object passing between such transmitter and receiver contained thereon.

SUMMARY OF THE INVENTION

In accomplishing these and other objects there is provided, according to one aspect of the present invention, an apparatus comprising substantially horizontally disposed support means; at least two substantially vertical members attached to the support means and extending upwardly therefrom; sensing means disposed on the vertical members to detect the passage of an object between two of the vertical members; flotation means coupled to at least one of the vertical members or support means; and anchoring means for coupling at least one of the vertical members or support means to a substantially stationary object.

BRIEF DESCRIPTION OF THE DRAWINGS

The invention will be more clearly understood as reference is made to the following specification read in conjunction with the drawings wherein.

DETAILED DESCRIPTION

Figure 1:
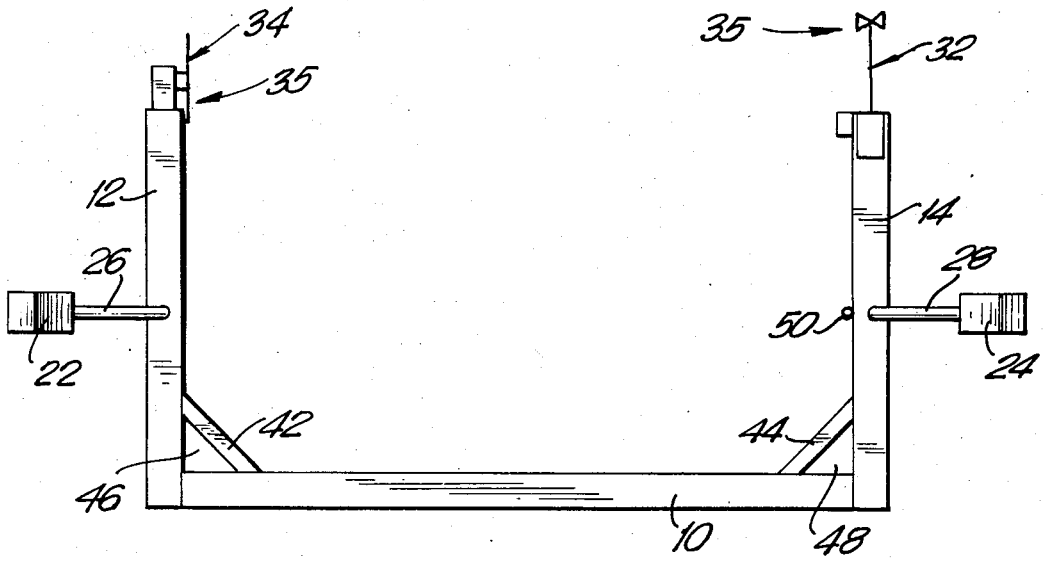
FIG. 1 is a frontal view of the apparatus.

In the description of the present invention that follows, it is to be noted that like parts are designated by like reference numerals throughout the several views of the accompanying drawings. It is further to be noted that, for the sake of brevity, the present invention will be hereinafter described in conjunction with its use in a sailboat race.

According to the embodiment of the invention shown generally in FIG. 1, two substantially vertical members 12 and 14 are attached at opposite ends of a substantially horizontal support means 10 and extend upwardly therefrom. Flotation means 22 and 24 are attached to said vertical members 12 and 14 by means of extension bars 26 and 28 which may be movably adjusted along the height of said vertical members 12 and 14. Note that the degree of flotation (i.e., the buoyancy) of the flotation means 22 and 24 and the weight of the remainder of the apparatus (the support means and the vertical members) must be chosen with due regard to each other such that the support means 10 remains submerged and the vertical members 12 and 14 are kept substantially erect when the apparatus is placed in water. Transmitting means 32 and receiving means 34 (hereinafter referred to collectively as sensing means 35) may be disposed at the upper ends of said vertical members 14 and 12, respectively, such that a signal from transmitting means 32 to receiving means 34 will be interrupted by the passage of an object therebetween. Alternatively, the sensing means can comprise transmitter/receiver means disposed at the upper end of one vertical member and reflecting means disposed at the upper end of the other vertical member. In such case, a signal from the transmitter/receiving means to the reflecting means and back will be interrupted by the passage of an object therebetween.

Rigid cross bars 42 and 44, preferably of metal or plastic composite material, may be provided as structural stiffeners between each vertical member 12 and 14 and the horizontal support means 10 to provide for structural integrity and resistance to torsional twist of the upright segments of the vertical members 12 and 14 from the plane established by the overall apparatus. Rigid plates 46 and 48, preferably of metal or composite material, may be disposed between cross bars 42 and 44, respectively, and the vertical members 12 and 14 and the support means 10 connected by said cross bars, respectively, to further provide in-water stability on the vertical plane of the apparatus against currents and other natural movement of the water.

Figure 2:
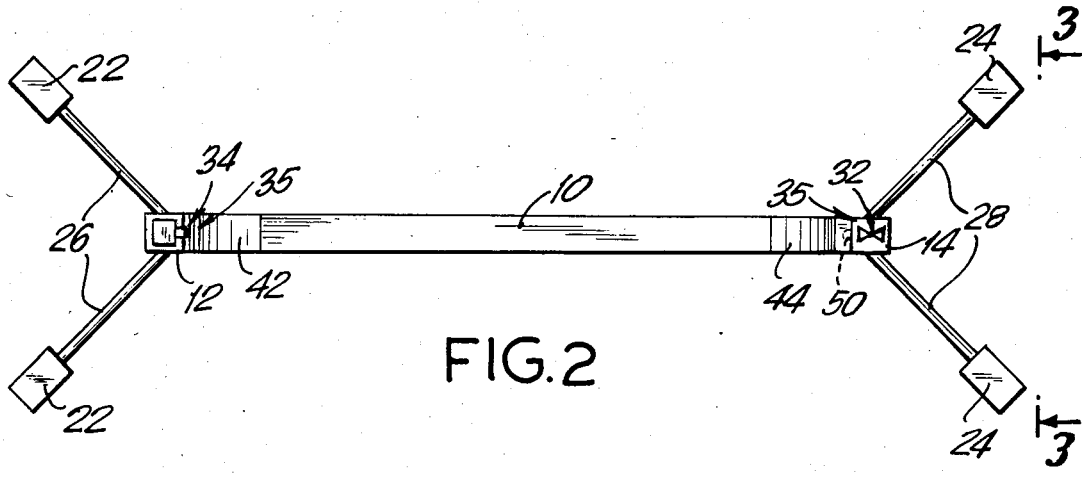
FIG. 2 is a top plane view of the apparatus.
Figure 3:
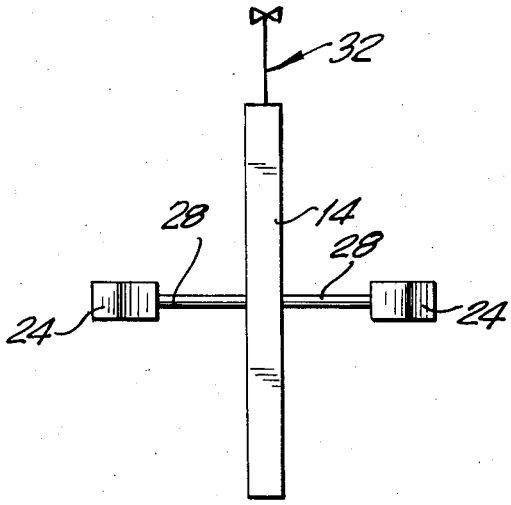
FIG. 3 is a side view of the apparatus taken along line 3—3 of FIG. 2 showing a single vertical member with flotation means and sensing means coupled thereto.

In operation, the apparatus is placed in water and will come to rest at the level of the flotation means 22 and 24. FIG. 2 illustrates that the vertical members 12 and 14 may be rigged with two or more flotation means 22 and 24 each. As mentioned above, the flotation means 22 and 24 may be adjustably secured at various heights along the vertical members 12 and 14 in order to displace the apparatus at selected depths in the water. As depicted in FIGS. 1–3, the flotation means 22 and 24 may be secured to the vertical members 12 and 14 by means of extension bars 26 and 28, and the disposition of such flotation means at angles away from the vertical axis defined by the horizontal support means 10 and vertical members 12 and 14 adds to the stability of the apparatus against the natural movement of the water. Naturally, other means, such as securing straps, may be used to secure the flotation means 22 and 24 to the vertical members 12 and 14.

Once displaced in the water, the apparatus may be secured to the water bed or other substantially stationary object by means of cable or the like attached to an eyelet 50 shown in FIGS. 1 and 2. The eyelet 50 can also be a hook or similar means on the apparatus. To ensure further stability in the water, the horizontal support means 10, the plates 46 and 48, the cross bars 42 and 44, and those portions of the vertical members 12 and 14 which will be disposed underwater may be made of porous material or may otherwise be fitted with holes and shall be of suitable weight to provide negative buoyancy for the portion of the structure below water. Consequently, the natural movement of water is prevented from exerting any upward force on the underwater portions to cause the apparatus to capsize.

Once the apparatus is secured in place, the vertical members 12 and 14 serve as a gate between which the participants of the sailboat race must pass. The reference line between the vertical members may naturally serve as a starting, finishing, or intermediate line for such a race, and, indeed, the apparatus in question may be placed wherever desired along the course of the race.

Upon passage of a participant between the vertical members 12 and 14, the sensing means 35 disposed on such vertical members may be used to electronically trigger the timing device utilized at that point in the race. Accordingly, in addition to accurately determining the point in time in which the participant passes through the gate, it is also possible to determine premature starts and the like.

As should be evident from the foregoing, the present invention allows for the accurate timing of water-based sports and eliminates the errors associated with timing of such sports by eye. This apparatus further eliminates human observation errors associated with the presence of other objects in the vicinity of a timing reference line and difficulties associated with angles of view of the reference line.

Naturally, various sensing means 35 may be utilized for a multitude of timing and management aspects of such races. Among these are means sensitive to various methods of coding the participants, such as color-sensing or signal-sensing means, to ensure that specific participants pass through appropriate gates at appropriate times as well as means sensitive to such variables as size, velocity, or heat to ensure that a gate's timing device is only triggered by appropriate participants in the race, rather than any object passing through the vertical members. Examples of different sensing means are infrared sensing means which detect the heat given off by the engine of a motorboat passing therethrough and color-sensing means as disclosed in U.S. Pat. No. 3,890,463.

Other modifications and uses of and departures from the specific embodiments described herein may be practiced by those skilled in the art without departing from the inventive concepts. Consequently, the invention is to be construed as embracing each and every novel feature and novel combination of features present and possessed by the apparatus and techniques herein disclosed and limited solely by the spirit and scope of the appended claims.

What is claimed is:

1. An apparatus for timing the movement of objects during water-based events, which comprises:

substantially horizontally disposed support means;

at least two substantially vertical members attached to the support means and extending upwardly therefrom;

flotation means coupled to at least one of the vertical members or support means for keeping the apparatus afloat and, in combination with the support means and the vertical members, for maintaining the support means submerged and the vertical members substantially erect when the apparatus is placed in water;

sensing means disposed on the vertical members to detect the passage of an object between two of the members; and anchoring means for coupling at least one of the vertical members or support means to a substantially stationary object.

2. The apparatus of claim 1 wherein the flotation means may be adjustably disposed along the vertical members.

3. The apparatus of claim 2 wherein the flotation means comprises buoyant floats adjustably attached to the vertical members by extension bars.

4. The apparatus of claim 1 wherein crossbars are disposed between and couple the vertical members to the support means.

5. The apparatus of claim 4 wherein plates are disposed between the crossbars and the vertical members and support means coupled by the crossbars.

6. The apparatus of claim 1 wherein the sensing means comprises a transmitter and a receiver, each attached to a different vertical member.

7. The apparatus of claim 1 wherein the sensing means comprises transmitting and receiving means and reflecting means, each attached to a different vertical member.

8. The apparatus of claim 1 wherein the anchoring means comprises a cable attached to the apparatus through an eyelet.

9. The apparatus of claim 1 wherein the support means is a rigid bar having holes disposed therethrough.

10. An apparatus for timing the movement of objects during water-based events, which comprises:

substantially horizontally disposed support means;

at least two substantially vertically disposed members attached to the support means;

flotation means coupled to at least one of the vertical members or support means for buoying the apparatus and, in combination with the support means and the vertical members, for maintaining the support means submerged and the vertical members substantially erect when the apparatus is placed in water;

sensing means disposed on the vertical members to detect the passage of an object between two of the members;

timing means to determine the interval between some initial time and the passage of the object; and anchoring means for coupling at least one of the vertical members or support means to a substantially stationary object.

11. An apparatus for timing the movement of objects during water-based events, which comprises:

substantially horizontally disposed support means;

at least two substantially vertically disposed members attached to the support means;

buoyant floats attached to the members;

crossbars disposed between and coupling at least two of the members to the support means;

plates disposed between at least one of the crossbars and the member and support means coupled by the crossbar;

sensing means attached to at least two members to detect the passage of an object between those members to which the sensing means is attached; and anchoring means for coupling at least one of the members or support means to a substantially stationary object.

12. The apparatus of claim 11 further comprising:

timing means to determine the interval between some referred time and the passage of the object between the members on which the sensing means are disposed.

* * * * *